US005865073A

United States Patent [19]

Wilson et al.

[11] Patent Number: 5,865,073

[45] Date of Patent: Feb. 2, 1999

[54] TORQUE MACHINES

[75] Inventors: Alexander J. Wilson; Neil Hardie, both of Kintore; Kenneth Cruickshank, Blackburn; Ronald Dent, Kintore, all of Scotland

[73] Assignee: Camco International Inc., Houston, Tex.

[21] Appl. No.: 725,283

[22] Filed: Oct. 2, 1996

[30] Foreign Application Priority Data

May 18, 1996 [GB] United Kingdom ..... 9610449

[51] Int. Cl.[6] ..... B25B 13/50; B25B 13/58

[52] U.S. Cl. ..... 81/57.33; 81/57.17; 81/57.18; 81/185; 279/46.6; 279/46.7

[58] Field of Search ..... 81/185.1, 57.15–57.21, 81/57.33–57.34, 185, DIG. 11, 124.4; 279/151, 46.5, 46.7, 43.5, 43.7

[56] References Cited

U.S. PATENT DOCUMENTS

| | | | |
|---|---|---|---|
| 2,459,899 | 1/1949 | Stoner | 279/46.7 |
| 3,008,363 | 11/1961 | Cook | 81/185 X |
| 3,029,673 | 4/1962 | Godsey | 81/185 |
| 3,188,101 | 6/1965 | Westberg | 279/46.7 X |
| 3,411,796 | 11/1968 | Decker | 279/46.6 X |
| 3,704,638 | 12/1972 | Nicholson et al. | 81/57.18 |
| 3,799,010 | 3/1974 | Guier | 81/57.17 |
| 4,309,041 | 1/1982 | Peterson et al. | 279/46.7 |
| 4,827,808 | 5/1989 | Haynes et al. | 81/57.18 |
| 5,221,099 | 6/1993 | Jänsch . | |
| 5,388,485 | 2/1995 | Auble | 81/64 |

FOREIGN PATENT DOCUMENTS 1238109 7/1971 United Kingdom .

*Primary Examiner*—D. S. Meislin

[57] ABSTRACT

A torque machine, for making or breaking screw-threaded joints between lengths of pipe, includes a rotatable head having an aperture into which a length of pipe is introduced, the rotatable head including a number of tongs which are spaced apart around the aperture and can be moved inwardly to grip the length of pipe. A separate jaw collar is provided for location between the tongs and the pipe, the collar comprising a number of part-annular sectors which are connected by springs or elastic links so that the collar is expansible to accommodate slight variations in pipe diameter. Collars of different internal diameters are used according to the diameter of the pipes to be joined. The collar may be of aluminium or other comparatively soft material to avoid marking of the pipes.

6 Claims, 3 Drawing Sheets

FIG 3
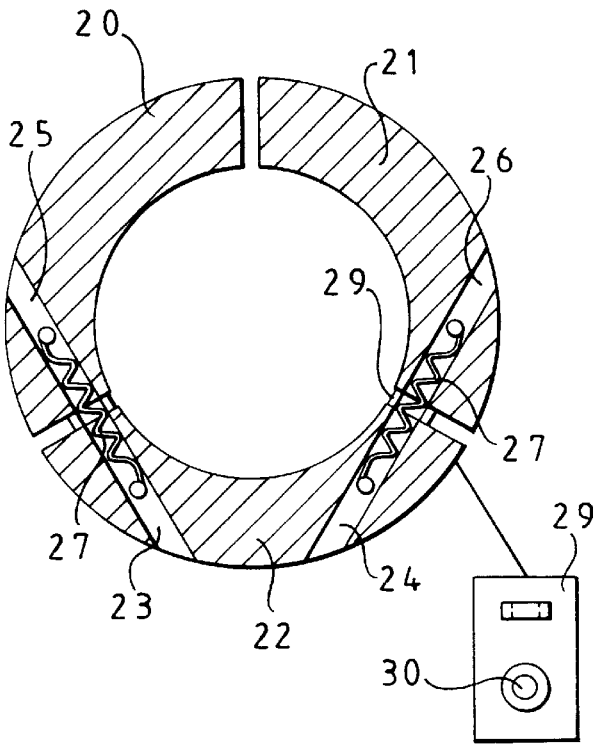
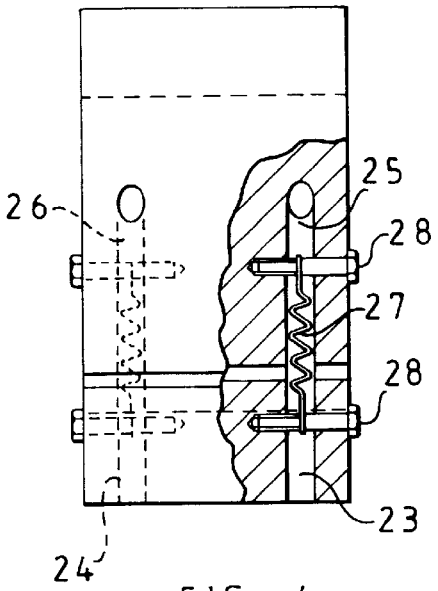
FIG 4
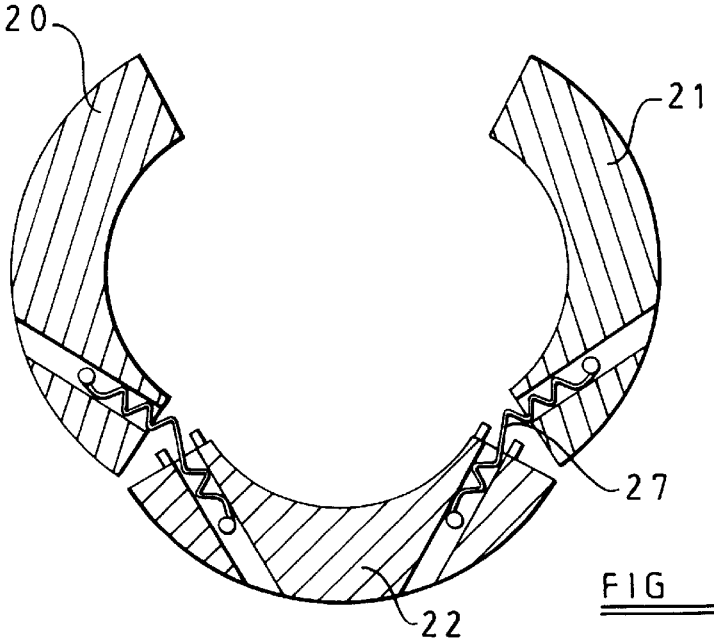
FIG 5

TORQUE MACHINES

BACKGROUND OF THE INVENTION

1. Field of the Invention

The invention relates to torque machines for making and breaking screw-threaded joints between lengths of pipe. Such machines are commonly used in the oil industry for screwing together sections of drill pipe and the invention will be particularly described in relation to this application, although it will be appreciated that the invention is also applicable to torque machines for making and breaking screw-threaded pipe joints for other purposes.

2. Description of Related Art

The invention relates to torque machines of the kind including a rotatable head having an aperture which, in use, surrounds a length of the pipe to be joined, the rotatable head having mounted thereon a plurality of powered jaws which are spaced apart around the aperture and which are movable inwardly and outwardly towards and away from the length of pipe. The machine will normally also include a non-rotatable head and jaw assembly for holding one pipe section stationary while the other pipe section is rotated by the rotatable head. One pipe section is passed through the stationary head and the jaws of that head are moved inwardly so as to tightly grip the pipe section. The other pipe section is similarly introduced through the aperture in the rotatable head until its threaded end is in contact with the threaded end of the other pipe section and the jaws moved inwardly to grip the pipe. The rotatable head is then rotated so as to screw the pipe sections together to form the joint, the two heads being capable of axial movement towards and away from one another as the joint is made up or broken.

A disadvantage with existing torque machines of this type is that the maximum inward and outward travel of the jaws is comparatively small, for example of the order of half an inch, with the result that each head and jaw assembly is suitable for use with only one nominal diameter of pipe. For example, a head assembly with jaws suitable for use with 4½" pipe cannot be used with 7" pipe. If it is required to change the size of pipe to be connected, it is necessary to replace the jaws with ones suitable for the new pipe size, and in some cases replacement of the whole head assembly may be necessary. This can be a time-consuming and laborious task.

Furthermore, when using some types of pipe, for example pipe with a high chromium content, it may be necessary or desirable to avoid marking the surface of the pipe by the jaws. With existing torque machines, this may be achieved by replacing the innermost part of each jaw by a so called "soft shoe", designed to grip the pipe without marking it. However, it is again a time-consuming and labourious operation to fit such shoes and to replace them when a new size of pipe is to be handled. Also, it is often found that presently available soft shoes may not be completely non-marking and although they may be an improvement on the standard jaw jaws they may still leave indentations on the pipe.

The present invention sets out to provide improved apparatus and methods for overcoming these disadvantages.

SUMMARY OF THE INVENTION

According to the invention there is provided a torque machine for making and breaking screw-threaded joints between lengths of pipe, including a rotatable head having an aperture which, in use, surrounds a length of pipe, the rotatable head having mounted thereon a plurality of jaws which are spaced apart around said aperture and which are movable inwardly and outwardly towards and away from the length of pipe, and a separate jaw collar which may be removably located between said jaws and the pipe, the collar having an outer surface for engagement by the jaws and an inner surface for frictional engagement with the outer surface of the pipe.

Since the jaw collar is separate from the rotatable head and jaws, there may be provided with the machine a range of different collars suitable for use with different pipe sizes. The basic jaw assembly of the machine may thus be appropriate for the maximum diameter of pipe with which the machine is to be used, and when the machine requires to be used with a smaller diameter of pipe, the appropriately sized collar is simply placed between the jaws and the outer surface of the pipe without any necessity for dismantling or replacing the jaws or any other part of the head assembly. Also, the collar may be of any appropriate material, and where it is wished to avoid marking of the surface of the pipe, the collar may be of an appropriate soft material, such as aluminium.

Preferably the jaw collar is radially expansible to accommodate slight variations in the diameter of the pipe to which it is applied. For example, the collar may comprise a plurality of part-annular sectors at least some of which are connected by connection means which permit relative displacement between adjacent sectors to render the collar expansible.

Each connection means may comprise a spring, such as a helical tension spring, opposite ends of which are connected to the adjacent part annular sectors respectively. Each spring may be received at least partly within aligned recesses or passages in said adjacent sectors.

Alternatively, each connection means may comprise a resiliently extensible link opposite ends of which are connected to the adjacent part-annular sectors respectively. For example, each link may be formed from elastic material, such as neoprene rubber, and may be pivotally connected at its ends to the adjacent part annular sectors respectively.

Preferably, connection means are not provided between one pair of adjacent part annular sectors to permit those sectors to be separated whereby the jaw collar may be fitted around the length of pipe from the side, to avoid the necessity of passing the collar axially along the pipe section.

The part annular sections of the jaw collar are preferably formed from a material which is softer than the material of the jaws and/or the pipe. In addition, a layer of frictional material may be disposed between the inner surface of the jaw collar and the outer surface of the pipe. For example, the frictional material may comprise an abrasive gauze membrane or a sheet of abrasive sandscreen material.

The invention includes within its scope a jaw collar for use in a torque machine of the kind first referred to, the jaw collar comprising a plurality of part annular sectors connected by connection means which permit relative displacement between adjacent sectors. The jaw collar may have any of the other constructional features referred to above.

The invention also provides a method of using a torque machine of any of the kinds referred to above comprising the steps of fitting the separate extensible jaw collar around a length of pipe, introducing the pipe with the jaw collar into the aperture in the rotatable head of the torque machine, so that the jaw collar is aligned with the jaws of the rotatable head, and moving said jaws inwardly to engage the outer surface of the jaw collar and clamp the jaw collar into firm frictional engagement with the pipe.

BRIEF DESCRIPTION OF THE DRAWINGS

FIG. 3 is a cross section through one form of jaw collar for use in the invention;

FIG. 4 is a part side elevation/part longitudinal cross section through the jaw collar;

FIG. 5 shows the jaw collar of FIGS. 3 and 4 partly opened for application to a pipe section.

DETAILED DESCRIPTION OF THE PREFERRED EMBODIMENTS

Figure 1:
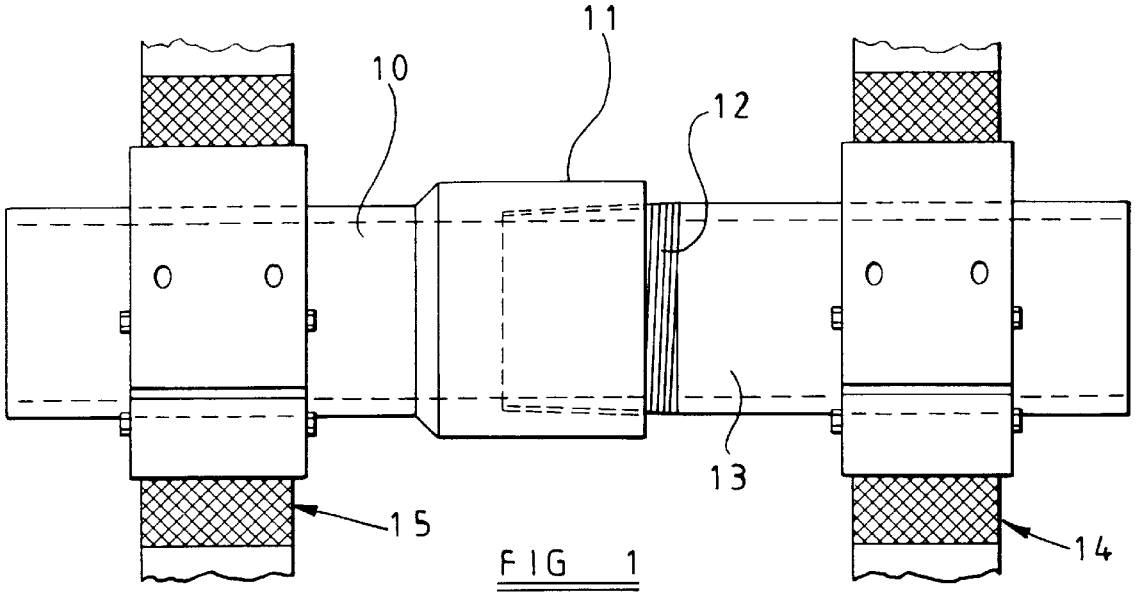
FIG. 1 is a diagrammatic part section/part side elevation showing a torque machine according to the present invention being used to make up a pipe joint.

Referring to FIG. 1, a typical pipe section 10 is formed at its end with an internally threaded socket 11 which receives a tapered threaded end portion 12 of a further pipe section 13.

Figure 2:
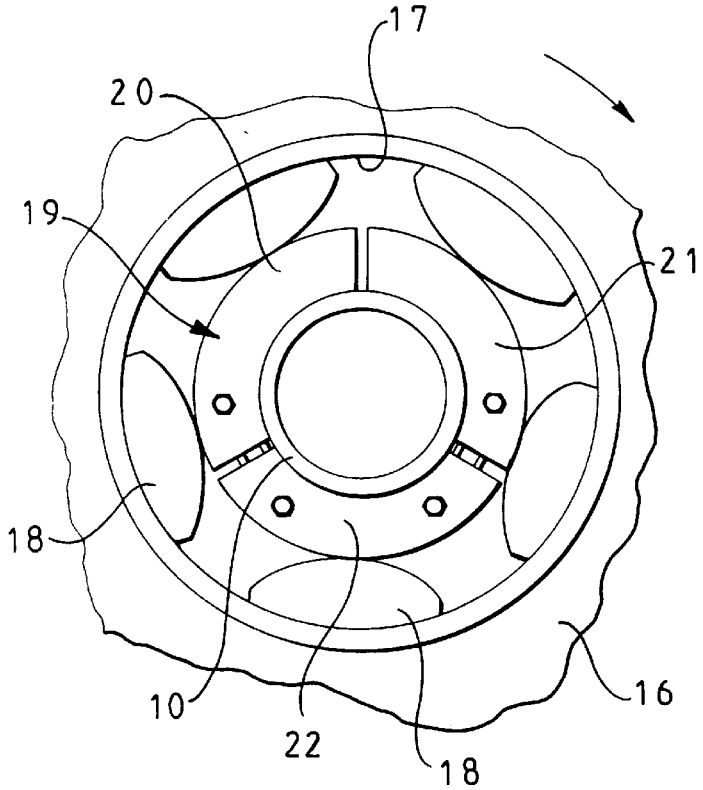
FIG. 2 is a diagrammatic front elevation of the torque machine.

The torque machine comprises a stationary or back-up head 14 which holds the pipe section 13 stationary, and a rotatable driving head 15 by means of which the pipe section 10 is rotated about its longitudinal axis to make up or break out the pipe joint. FIG. 2 is an end elevation of the driving head. The back-up head 14 is of similar construction and differs only in that it is non-rotatable.

Referring to FIG. 2, the rotating head comprises a rotatable support frame 16 formed with a circular aperture 17. Movably mounted on the support frame 16 are five jaws 18 which are equally spaced apart around the aperture 17 and project into the aperture. The inwardly facing surfaces of the jaws 18 are convexly curved. The tongs 18 can be moved inwards and outwards under power by an appropriate mechanism, for example a power-driven camming mechanism, on the support 16.

The torque machine as so far described is conventional and will be familiar to those skilled in the art and will not therefore be described in detail. Normally, the jaws 18 would themselves directly engage the outer periphery of the pipe section so as to hold it frictionally so that it rotates with the support 16. However, as previously described, since the range of movement of the jaws 18 is comparatively short, a particular head assembly can only be used with one nominal size of pipe and a different head assembly, or different jaws, are required for use with each different size of pipe. Also, where marking of the surface of the pipe is liable to occur, it may be desirable to replace the normal innermost portions of the jaws 18 by special soft shoes for engagement with the surface of the pipe. FIG. 2 shows how these disadvantages are overcome according to the present invention.

According to the invention, each pipe section is encircled by an annular collar 19 which is separate from the jaws and comprises three part-annular sectors 20, 21 and 22 connected together. The external diameter of the collar 19 is the same as the nominal diameter of the size of pipe appropriate to the particular arrangement of the jaws 18. The internal diameter of the collar 19 is the same as the outer diameter of the pipe 23 with which the machine is to be used.

The means connecting the sectors of the collar together will be described in greater detail with reference to FIGS. 3, 4, 5 and FIGS. 6, 7 8.

In use, the collar 19 is placed around the pipe section and the pipe section, with the collar, is introduced into the aperture 17 until the collar 19 is aligned with the jaws 18. The jaws 18 are then moved inwardly so as to engage the outer surface of the collar 19 and clamp the collar firmly onto the pipe. The other, back-up head assembly 14, which holds the other pipe section 13 stationary, is provided with a similar collar for clamping onto the pipe section 13. The support 16 is then rotated in the appropriate direction to make or break the screw threaded joint. One of the two head assemblies 14, 15 is able to float axially so as to move axially relative to the other head assembly as the joint is made or broken.

If the machine is to be used with a different size of pipe, then two collars 19 having the same external diameter but an appropriate different internal diameter are selected from a range of collars of different internal diameters. It will be appreciated that the machine may therefore be used with different sizes of pipe without any time consuming and labourious modification of the machine itself making it simple and quick to switch from one pipe size to another.

The collars 19 may be of any suitable material. However, the invention is particularly applicable for use with pipe, such as pipe of high chromium content, which is liable to be marked or indented by the jaws of a conventional torque machine. In this case, the collars 19 are made of a suitable material, such as aluminium, which is softer than the material of the pipe so as to prevent marking of the pipe.

In order to provide adequate grip between the internal peripheral surface of each collar 19 and the surface of the pipe, there may be inserted between those surfaces a sheet of sandscreen abrasive paper or an abrasive gauze membrane. It is found that using a layer of such material between the collar and the pipe improves the grip without significantly marking the surface of the pipe.

FIGS. 3–5 show one form of collar 19 in greater detail.

Referring to FIGS. 3 and 4, the sector 22 of the collar is formed with two bores 23, 24 disposed at about 60° to one another. The bore 23 is aligned with a similar bore 25 in the sector 20 and the bore 24 is aligned with a bore 26 in the sector 21. A helical metal tension spring 27 is located in each pair of aligned bores, the ends of the tensions springs being held by bolts 28. Between the ends of the sector 22 and each of the sectors 20 and 21 is a rubber spacer washer 29 formed with an aperture 30 through which the spring 27 passes.

No form of connection is provided between the sectors 20 and 21 and this enables these sectors to be separated, as shown in FIG. 5, so that the collar may be fitted from the side over a length of pipe. The separation of the sectors 20 and 21 is opposed by the resilient extension of the springs 27.

When the collar is fitted around the pipe section, as shown in FIG. 2, the gaps between the ends of the sectors 20, 21 and 22 allow slight inward or outward movement of the sectors to allow for slight variations in the diameter of the pipe. The springs 27 also serve to hold the sectors of the collar against the pipe as the pipe is introduced into the torque machine.

Figure 6:
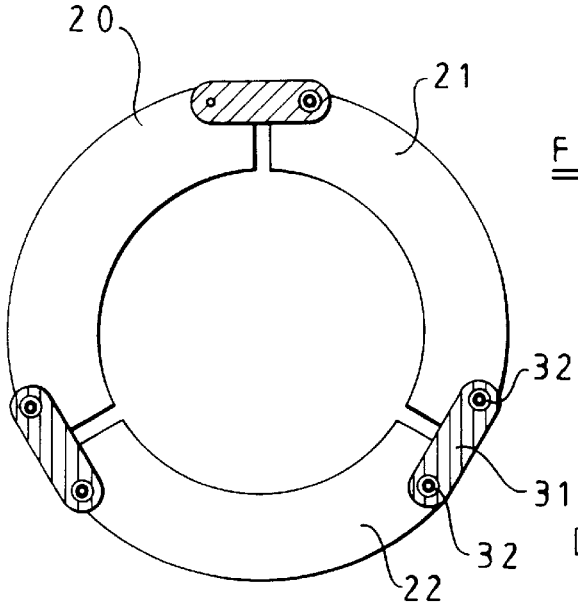
FIGS. 6, 7 and 8 are similar views to FIGS. 3, 4 and 5 of an alternative form of jaw collar.
Figure 7:
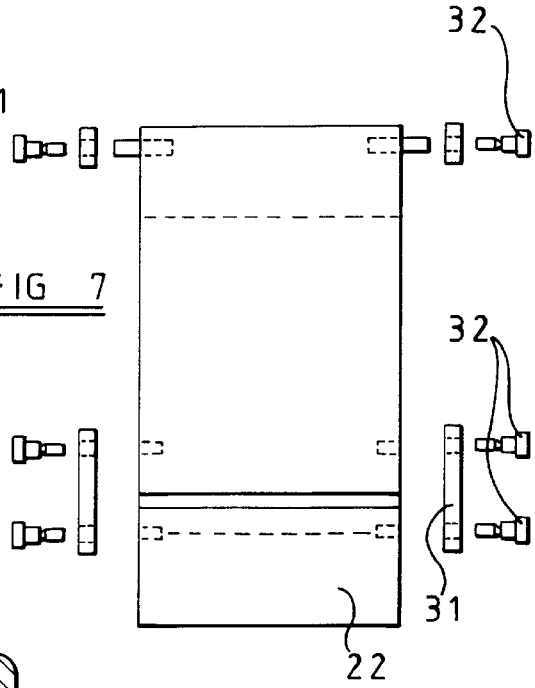
Figure 8:
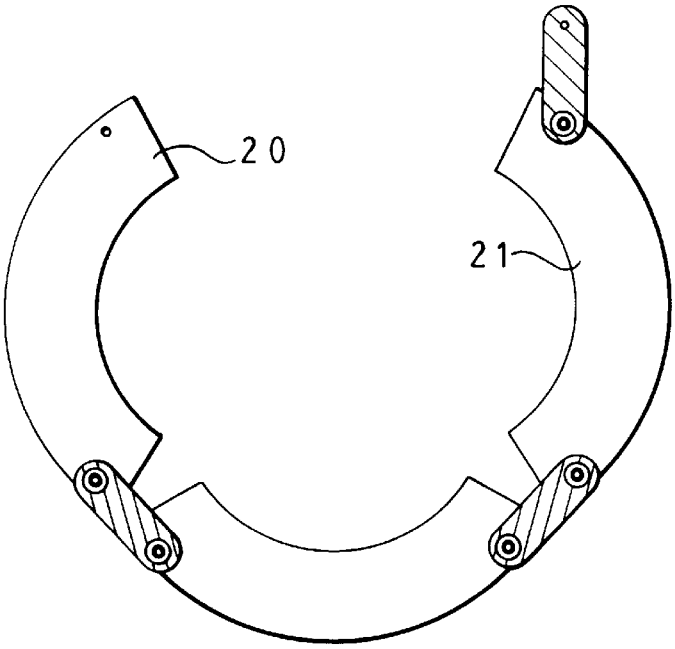

In the alternative arrangement shown in FIGS. 6–8, the sectors 20, 21 and 22 of the collar are connected by pairs of neoprene rubber links 31 which are pivotally connected to opposite faces of the sectors by screws 32.

In the case of each of the links between the sectors 20 and 21, one of the screws is replaced by a roll pin which may readily be removed to allow the links to be swung apart, as shown in FIG. 8, for mounting of the collar on the pipe, the roll pins being re-fitted when the collar is in position around the pipe. Alternatively, the links between the sectors 20 and 21 may be omitted entirely, relying on the resilience of the other links to maintain the collar in position around the pipe.

In this arrangement the flexibility of the neoprene links 31 is sufficient to accommodate slight variations in the diameter of the pipe with which the collar is used.

Whereas the present invention has been described in particular relation to the drawings attached hereto, it should be understood that other and further modifications, apart from those shown or suggested herein, may be made within the scope and spirit of the present invention.

What is claimed:

1. A torque machine for making and breaking screw-threaded joints between lengths of pipe, including a rotatable head having an aperture which, in use, surrounds a length of pipe, the rotatable head having mounted thereon a plurality of jaws which are spaced apart around said aperture and which are movable inwardly and outwardly towards and away from the length of pipe, and a separate jaw collar which may be removably located between said jaws and the pipe, the collar having an outer surface for engagement by the jaws and an inner surface for frictional engagement with the outer surface of the pipe, the collar comprising a plurality of non-flexible part-annular sectors at least some of which are connected by a resiliently extensible link opposite ends of which are connected to the adjacent part annular sectors respectively to permit relative displacement between adjacent part-annular sectors to render the collar expansible, each link being formed from elastic material, and being pivotally connected at its ends to the adjacent part-annular sectors respectively.

2. A torque machine according to claim 1, wherein an extensible link is not provided between one pair of adjacent part-annular sectors to permit those sectors to be separated whereby the jaw collar may be fitted around the length of pipe from the side.

3. A torque machine according to claim 1, wherein the jaw collar is formed from a material which is softer than a material from which the pipe is formed.

4. A torque machine according to claim 1, wherein a layer of frictional material is disposed between the inner surface of the jaw collar and the outer surface of the pipe, the frictional material being selected from an abrasive gauze membrane and a sheet of abrasive sandscreen material.

5. A jaw collar for use in a torque machine of the kind comprising a rotatable head having an aperture which, in use, surrounds a length of pipe, the rotatable head having mounted thereon a plurality of jaws which are spaced apart around said aperture and which are movable inwardly and outwardly towards and away from the length of pipe, the jaw collar, for location between the tongs and the pipe, being generally cylindrical and comprising a plurality of part-annular sectors connected by connection means which permit relative displacement between adjacent sectors to render the collar expansible, each connection means comprising a resiliently extensible link opposite ends of which are connected to the adjacent part-annular sectors respectively, each link being formed from elastic material, and being pivotally connected at its ends to the adjacent part-annular sectors respectively.

6. A jaw collar according to claim 5, wherein connection means are not provided between one pair of adjacent part annular sectors to permit those sectors to be separated whereby the jaw collar may be fitted around the length of pipe from the side.

* * * * *